United States Patent [19]

Tentarelli et al.

[11] 4,323,875

[45] Apr. 6, 1982

[54] METHOD OF MAKING TEMPERATURE SENSITIVE DEVICE AND DEVICE MADE THEREBY

[75] Inventors: Joseph A. Tentarelli, Drexel Hill; Richard L. Wahlers, Churchville; John G. Woods, Philadelphia, all of Pa.

[73] Assignee: TRW, Inc., Cleveland, Ohio

[21] Appl. No.: 226,559

[22] Filed: Jan. 21, 1981

[51] Int. Cl.[3] ..... H01C 3/04; H01C 7/02; B05D 5/12

[52] U.S. Cl. ..... 338/25; 29/612; 427/101; 427/103; 427/383.1

[58] Field of Search ..... 338/25; 29/612; 427/101, 103, 383.1

[56] References Cited

U.S. PATENT DOCUMENTS

| | | | |
|---|---|---|---|
| 2,847,325 | 8/1958 | Riseman et al. | 427/101 |
| 3,660,158 | 5/1972 | Chen et al. . | |
| 3,748,174 | 7/1973 | Chen et al. . | |

OTHER PUBLICATIONS

Marton, J. P., et al, "A Sensitive Thin Film Temperature Sensor", International Electrical, Electronics Conference and Exposition, Paper No. 77184, Toronto, Canada, Sep. 26–28, 1977, Report pp. 130–131.

"Thin Film Nickel Resistance Thermometers," by H. Burkard, VIDE, vol. 196, Suppl., 1979, pp. 79–83.

"Structural and Electrical Properties of Chromium and Nickel Films Evaporated in the Presence of Oxygen," K. Hieber and L. Lassak, Thin Solid Films, 20 (1974) pp. 63–73.

*Primary Examiner*—William R. Dixon, Jr.

*Attorney, Agent, or Firm*—Jacob Trachtman

[57] ABSTRACT

A method of making a thin nickel film temperature sensitive device with a relatively high positive temperature coefficient of resistance utilizing a film of nickel deposited from a bulk nickel source onto an electrically insulating substrate, and device made thereby including the step of heat treating a resistor element having a thin film of nickel deposited on an electrically insulating substrate by heating in a reducing atmosphere to a peak temperature of at least 550° C., over a heating cycle of at least about 20 minutes. The nickel film of the heat treated resistor element has a selected temperature coefficient of resistance which is at least 60% of the value of the coefficient for the bulk nickel and a sheet resistance of at least one ohm per square which properties are determined by the heat treating temperature and cycle time, and the thickness of the nickel film. The resistor element can be made by vacuum depositing the nickel film to the desired thickness onto the insulating substrate, and affixing terminations to the ends of the resistor element and applying a protective outer coating to the nickel film after the heat treating of the element.

38 Claims, 2 Drawing Figures

FIG. 1
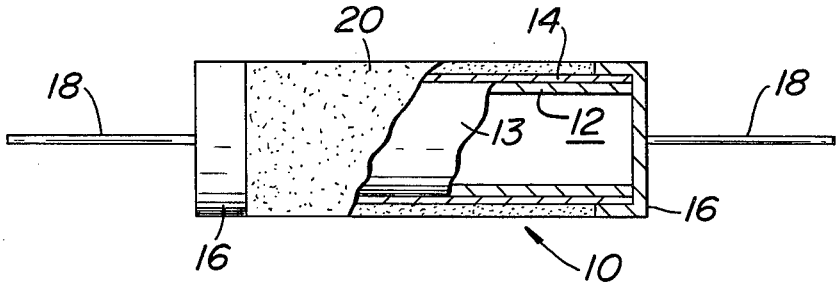
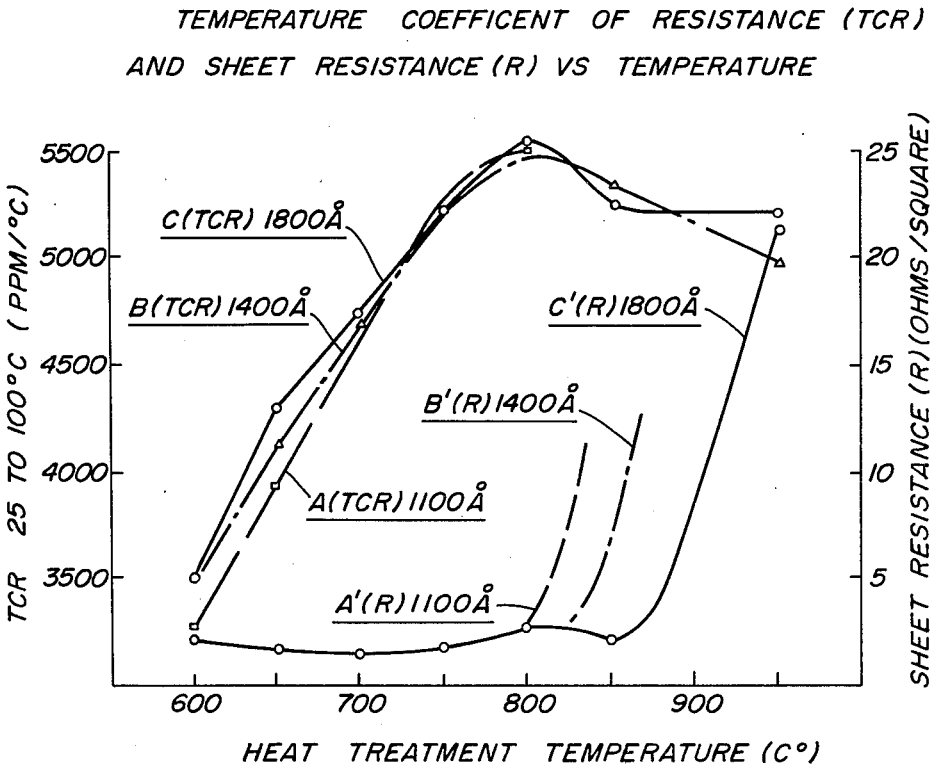
FIG. 2

METHOD OF MAKING TEMPERATURE SENSITIVE DEVICE AND DEVICE MADE THEREBY

The invention relates to a method of making a temperature sensitive device of the thin film type and the device made thereby providing a relatively high positive temperature coefficient of resistance.

Thin film temperature sensitive devices have been made by depositing metal films upon an insulating substrate. To obtain high temperature sensitivity, metals characterized by high temperature coefficients of resistance have been utilized. Because bulk nickel has a high positive temperature coefficient of resistance (TCR), this metal has been used to provide high temperature sensitivity.

However, it has been found that the high temperature coefficient of resistance which is provided by bulk nickel, is reduced with decreasing film thicknesses below about 5000 Å. Because of the low resistivity of bulk nickel, the nickel films utilized have been reduced in thickness to less than 5000 Å to increase sheet resistances for producing compact devices. As a result, prior art thin film devices of reduced film thickness have provided temperature coefficients of resistance which have been substantially less than that provided by the bulk metal.

SUMMARY OF THE INVENTION

Therefore it is an object of the invention to provide a new and improved method of making a temperature sensitive device of the thin film type.

Another object of the invention is to provide a new and improved method of making a thin film temperature sensitive device which may be simply and easily performed and provides a temperature sensitive device with a relatively high temperature coefficient of resistance as well as a relatively high sheet resistance.

Another object of the invention is to provide a new and improved method of making a thin film temperature sensitive device, and a device produced thereby which may have a nickel film thickness of less than 5000 Å providing a relatively high temperature coefficient of resistance as well as a relatively high sheet resistance.

Another object of the invention is to provide a new and improved method of making a nickel thin film temperature sensitive device utilizing heat treatment to provide a relatively high temperature coefficient of resistance of selected value within a range of 60% to 100% of the bulk value of nickel.

Another object of the invention is to provide a new and improved method for making a temperature sensitive device by heat treating a resistor element having a thin film of nickel substantially less than 5000 Å thick deposited on an electrically insulating substrate, to provide a temperature coefficient of resistance of a selected value up to approximately the bulk value of the metal, and which device has a sheet resistance greater than the comparable sheet resistance provided by bulk nickel.

Another object of the invention is to provide a new and improved method which may be safely, efficiently, and economically performed to provide thin film temperature sensitive devices which are inexpensive and provide selected desired temperature coefficients of resistance and relatively high sheet resistances of no less than about one ohm per square.

Another object of the invention is to provide a new and improved method of making a thin film temperature sensitive device utilizing a main heat treating step for providing desirable electrical properties for the device, and which method may include a preceding heat treatment for adjusting the desirable electrical properties, and a subsequent heat treatment for stabilizing the device.

Another object of the invention is to provide a new and improved method of making a thin film temperature sensitive device which includes a heat treating step in which the heating temperatures and times may be varied for selecting a desirable temperature coefficient of resistance and providing a relatively high sheet resistance for film thicknesses less than 3000 Å.

Another object of the invention is to provide a new and improved method of making a high quality thin film temperature sensitive electrical device which is compact and made of inexpensive materials utilizing a thin nickel film deposited on an insulating substrate to provide highly desirable electrical properties which may be easily controlled, and which device can be readily fabricated.

These objects are achieved by a method of making a temperature sensitive device utilizing a resistor element which may have a film of nickel of less than 5000 Å thick deposited on an electrically insulating substrate. The resistor element is treated by heating in a reducing atmosphere to a peak temperature of at least 550° C., over a heating cycle of at least about 20 minutes. After heat treatment, the resistor element has a sheet resistance of at least one ohm per square and provides the temperature sensitive device with a selected temperature coefficient of resistance which is in the range of 60% to 100% of the value of the coefficient for the bulk nickel source of the film. The temperature coefficient of resistance and the sheet resistance are determined by the heating temperature, the cycle time and nickel film thickness. The resistor element may be made by vacuum depositing the nickel film to the desired thickness onto the insulating substrate.

The temperature sensitive device may also be provided with a heat treating step preceding the reducing heat treatment, of heating the resistor element in air at a temperature of about 350° for a period of about one hour. For the purpose of stabilizing the temperature sensitive device, the heat treated resistor element may be heated in air at a temperature of about 250° for a period of about one hour.

The invention accordingly, comprises the method and the relation of one or more of its conditions and steps with respect to the other, and the device with its features and properties in relationship to its constituent which are exemplified in the following detailed disclosure, with the scope of the invention being indicated by the claims.

For an understanding of the nature and objects of the invention, reference should be had to the following detailed description taken in connection with the accompanying drawing.

DESCRIPTION OF DRAWING

FIG. 1 is a plan view of a temperature sensitive device of the present invention with a portion broken away, and FIG. 2 is a graphic illustration providing plots of the temperature coefficient of resistance and sheet resistance respectively against peak heat treatment temperatures for several temperature sensitive devices embodying the invention.

DETAILED DESCRIPTION

Refer to FIG. 1, which illustrates a temperature sensitive device 10 of the invention, comprising a resistor element 12 having a substrate 13 and a thin nickel resistance film 14 on the outer surface of the substrate. The substrate 13 may be in the form of a tube or rod and composed of an electrical insulating material, such as provided by glass, ceramic, and alumina or steatite materials. The thin nickel resistance film 14 which is preferably vacuum deposited on the substrate 13, is heat treated after deposition to provide the properties which are desired for the temperature sensitive device 10. The metal resistance film 14 is preferably coated on the substrate 13 by exposing the substrate to the vapors of nickel which are evaporated from a bulk metal nickel source in a high vacuum, in a manner such as described in U.S. Pat. No. 2,847,325. A terminal cap 16 of electrically conductive metal is mounted on each of the ends of the substrate 12 in electrical contact with the resistance film 14. Lead wires 18 of electrically conductive metal are secured to and project from the terminal caps 16. A protective covering 20 is desirably provided on the exposed portion of the resistance film 14 between the terminal caps 16.

In making the temperature sensitive device 10, it is preferable to utilize a resistor element 12 having its nickel film 14 vacuum deposited from a nickel source of high purity such as 99.97 or higher weight percent in a high vacuum of between $10^{-5}$ to $10^{-6}$ torr. Although not necessary, rotation of the resistor element 12 during deposition is desirable for obtaining an even coating on the outer surface of the substrate 13 as provided by the apparatus of U.S. Pat. No. 2,847,325. The film 14 may be formed at various deposition rates and rates between 3 Å and 25 Å per second have been found to be suitable for providing nickel film thicknesses between 1000 Å and 3000 Å. In addition to coating the substrate 13 by evaporation of nickel, sputtering, electron beam, and other techniques may also be utilized, although the desirable properties are not dependent upon such methods, on the application of bias voltages, or the use of heated substrates.

The heat treatment applied to the resistor element 12 controllably changes its electrical properties and provides desired relatively high temperature coefficients of resistance. The heat treatment can also be applied to increase the sheet resistance of the device 10. The resistor element 12 is heat treated in a reducing atmosphere to a peak temperature of at least 550° C. over a heating cycle of at least 20 minutes. The atmosphere is preferably slightly reducing, and a mixture of nitrogen and hydrogen has been utilized with a volume of hydrogen less than that of nitrogen. A reduced content of hydrogen is desirable for enhancing and increasing the value of the temperature coefficient of resistance of the heat treated device 10. Contents of 5% and 15% by volume of hydrogen, as well as 1% and lower have been found useful in providing the desired properties for the temperature sensitive device 10.

The peak temperature to which the resistor element 12 is heated and the heating cycle time are determined by the values of the temperature coefficient of resistance and sheet resistance which are desired. The values of the temperature coefficient of resistance and sheet resistance obtained also depend upon the thickness of the nickel film. Desirably high temperature coefficients of resistance of at least 60%, 80%, 90%, 95% and up to 100% of the bulk value of the nickel source material can be achieved with adjustment of the heat treating temperature, heat treatment cycle time, and film thickness. To achieve such results, heat treating temperatures from as low as about 550° C. and up to 950° C. and higher may be utilized. For the purpose of obtaining high temperature coefficients of resistance over a variety of values, peak temperatures in the range between 600° C. to 900° C. are desirable, while peak temperatures in a range of between 750° C. and 850° C. are preferred for high values of temperature coefficient of resistance. A peak value of about 800° C. has been found to be optimum for obtaining high values of temperature coefficient of resistance over a range of thicknesses for the nickel film of 1100 Å and lower, and up to 2800 Å and above.

Although a heat treatment cycle as low as 20 minutes may be utilized, the heat treating cycle may extend over periods of one-half hour to two and three hours, and higher. Since the variation of the cycle time as well as the heating temperature affect the properties of the temperature sensitive device, the cycle time is also selected to provide the desired electrical properties.

Depending upon the thickness of the nickel film the sheet resistance of the nickel film remains relatively constant for variations in peak temperature until a critical peak temperature is reached. Exceeding the critical temperature results in a rapid increase in the sheet resistance. In general, the values of the sheet resistance provided by the invention exceed the value of the comparable sheet resistance provided by the bulk nickel source, and is at least one ohm per square. The heat treatment also can provide a concurrent increase of both the temperature coefficient of resistance and sheet resistance of a device 10, over the values of the unheat treated resistor element 12. The actual changes in the values, however, are dependent upon the heat treatment conditions and the nickel film thickness. The invention, thus, comprises a method which is easily carried out in connection with a nickel film resistor element, which can be produced by simple vacuum deposition, and for film thicknesses of less than 5000 Å. Film thickness as thin as 3000 Å, 1100 Å, and less may be utilized for providing desirable results. However, with the use of nickel films of 1100 Å and less, lower peak heating temperatures and cycle times are required to prevent destruction of the nickel films.

In addition to the reducing heat treatment, the resistor element 12 may also be subjected to heat treating steps for modifying the properties of the temperature sensitive device 10. Thus, the reducing heat treatment may be preceded by a heat treatment in air at approximately 350° C. over a period of approximately one hour. Where desirable, the reducing heat treatment may also be followed by a heat treatment at a temperature of about 250° C. for approximately one hour in air for stabilizing the temperature sensitive device.

EXAMPLE 1

Temperature sensitive devices 10 were made by utilizing resistor elements 12 having vacuum deposited thereon a thin film of nickel with a thickness of approximately 1100 Å from a source of high purity bulk nickel in a vacuum of between $10^{-5}$ and $10^{-6}$ torr. The temperature coefficient of resistance of bulk nickel was about 5620 parts per million per °C. The temperature coefficient of resistance of the nickel film 14 of the resistor elements 12 prior to heat treatment, was 3327 ppm/°C. and its sheet resistance was 3.4 ohms/square. The resistor elements 12 were heat treated in a reducing atmosphere of 95 parts nitrogen and 5 parts hydrogen by volume. The heat treatment took place over a time cycle of 1 hour and at various peak temperatures from 600° C. to 950° C. for respective resistor elements 12. The temperature sensitive devices 10 were formed by the addition of caps 16 and leads 18 to the ends of the resistor elements 12. The devices 10 were tested for determining their electrical properties, and the results obtained are shown in Table 1.

TABLE 1

| Heat Treatment Temp (°C.) | TCR 25-100° C. (ppm/°C.) | Sheet Resistance (ohms/square) | Change in TCR By Treatment (ppm/°C.) |
|---|---|---|---|
| 600 | 3280 | 5.02 | −47 |
| 650 | 3980 | 5.99 | +653 |
| 700 | 4200 | 7.61 | +873 |
| 750 | 5340 | 8.26 | +2013 |
| 800 | 5500 | 3.73 | +2173 |
| 850 | * | * | — |
| 950 | * | * | |

*Firing at 850° C. and 950° C. resulted in open circuit

EXAMPLE 2

Temperature sensitive devices 10 were prepared as described in connection with Example 1, except that the resistor elements 10 were provided with a nickel film thickness of approximately 1400 Å. The temperature coefficient of resistance for the nickel film of the resistor elements 12 prior to heat treatment, was 3305 ppm/°C. and its sheet resistance was 2.1 ohms/square. The temperature sensitive devices 10 were tested for determining their electrical properties, and the results obtained are shown in Table 2.

TABLE 2

| Heat Treatment Temp (°C.) | TCR 25-100° C. (ppm/°C.) | Sheet Resistance (ohms/square) | Change in TCR By Treatment (ppm/°C.) |
|---|---|---|---|
| 600 | 3500 | 2.75 | +195 |
| 650 | 4120 | 3.24 | +815 |
| 700 | 4600 | 1.94 | +1295 |
| 750 | 5230 | 1.94 | +1925 |
| 800 | 5550 | 3.07 | +2245 |
| 850 | 5340 | 8.26 | +2035 |
| 950 | 4980 | 34.9 | +1675 |

EXAMPLE 3

Temperature sensitive devices 10 were prepared as described in connection with Example 1, except that the bulk nickel source had a temperature coefficient of resistance of about 5550 and the resistor elements 10 were provided with a nickel film thickness of approximately 1800 Å. The temperature coefficient of resistance of the nickel film of the resistor elements 12 prior to heat treatment, was B 3560 ppm/°C. and its sheet resistance was 1.8 ohms/square. The temperature sensitive devices 10 were tested for determining their electrical properties, and the results obtained are shown in Table 3.

TABLE 3

| Heat Treatment Temp (°C.) | TCR 25-100° C. (ppm/°C.) | Sheet Resistance (ohms/square) | Change in TCR By Treatment (ppm/°C.) |
|---|---|---|---|
| 600 | 3450 | 2.11 | −110 |
| 650 | 4310 | 1.78 | +750 |
| 700 | 4750 | 1.30 | +1190 |
| 750 | 5220 | 1.78 | +1660 |
| 800 | 5540 | 2.75 | +1980 |
| 850 | 5220 | 2.11 | +1660 |
| 950 | 5210 | 21.55 | +1650 |

The effects on the properties of the temperature sensitive device 10 of varying the heat treatment peak temperature and the nickel film thickness are provided by the data in the Tables 1, 2 and 3. These properties are also graphically illustrated in FIG. 2 which plots the temperature coefficient of resistance and sheet resistance respectively, against the heat treatment temperature for the various peak temperatures utilized in producing the temperature sensitive devices 10. The curve A plots the temperature coefficent of resistance for the devices of Example 1 having a nickel film thickness of approximately 1100 Å. Correspondingly, the curves B and C are for the devices 10 of Examples 2 and 3 having nickel film thicknesses of 1400 Å and 1800 Å respectively. The curves A, B and C illustrate the increasing values of the temperature coefficients of resistance corresponding to the utilization of increased peak temperature for the heat treatment. Thus, the temperature coefficient of resistance for the devices 10 may be selected and determined by the peak heating temperature to which the resistor element 12 is subjected. The peak value for temperature coefficients of resistance which approximate or equal the bulk value for the source nickel material are obtained at approximately 800° C. on a one hour heating cycle and decreases for peak temperatures exceeding 800° C. for the film of 1400 Å and 1800 Å. The film thickness only had a small effect on the temperature coefficients which were obtained. However, the thinner 1100 Å film of curve A, could not sustain peak heating temperatures of over 800° on the one hour cycle and resulted in open circuits for such devices 10.

The curves A', B' and C' show the sheet resistances for respective devices 10 of curves A, B and C having film thicknesses of 1100 Å, 1400 Å and 1800 Å. The curves A' and B' are limited to show only the rising sheet resistance characteristic obtained for peak temperatures above 800° C. From Tables 1, 2 and 3 it is seen that for temperatures under 800° C. sheet resistances are relatively constant for respective thicknesses and have values greater than one ohm/square. However, the value of sheet resistance is an inverse function, increasing with a decrease in film thickness.

For the examples illustrated by FIG. 2, utilization of a temperature up to 800° C. permits the selection of a temperature coefficient of resistance over a wide range, while having only a small effect upon the sheet resistances wich is relatively constant with temperature. Similarly for peak temperatures of 800° C. and higher, a high value of temperature coefficient of resistance may be obtained as well as a rapidly rising value of sheet resistance as the peak heat treating temperature increases. For situations where it is desirable to provide devices 10 with controlled electrical characteristics of close tolerance, the peak firing temperature of approximately 800° C. provides a maximum temperature coefficient of resistance, which varies only slightly for limited changes in the peak operating temperature. The use of film of different thickness, such as those of the devices 10 of Example 1, 2 and 3 shown by the curves A', B' and C', also allows selection of the desired sheet resistance. Thus, devices 10 may be produced with both electrical characteristics of temperature coefficient of resistance and sheet resistance within close tolerances. Where higher values of sheet resistance are important, this may be obtained by utilizing nickel films of appropriate thicknesses and selected higher peak heating temperatures.

Since the graph of FIG. 2 relates to the method of the invention utilizing a one hour heating cycle and the particular atmosphere specified in Example 1, further variation of the electrical properties of the temperature sensitive device 10 may be obtained by using other cycle times and reducing atmospheres.

Table 4 provides a summary of selected data given in connection with the Examples 1, 2 and 3 for temperature sensitive devices 10 with film thicknesses of 1100 Å, 1400 Å and 1800 Å. In addition, Table 4 also includes data for temperature sensitive devices 10 made as described in connection with Example 3, except that the resistor elements 12 had a film thickness of approximately 2800 Å. The data presented in Table 4 also provides calculated values for the changes obtained in the temperature coefficients of resistance and in the sheet resistances by the heat treatment of the resistor elements 12.

TABLE 4

| Film Thickness (A) | Before Heat Treatment TCR 25-100° C. (ppm/°C.) | Before Heat Treatment Sheet Resistance (R) (ohms/square) | Heat Treatment Temp (°C.) | After Heat Treatment TCR 25-100° C. (ppm/°C.) | After Heat Treatment TCR Change (%) | After Heat Treatment TCR % of Bulk Value | After Heat Treatment Sheet Resistance (R) (ohms/square) | After Heat Treatment Sheet Res. Ratio* ($R/R_{Bulk}$) |
|---|---|---|---|---|---|---|---|---|
| 1100 | 3327 | 3.4 | 650 | 3980 | 20 | 71 | 6.0 | 8.9 |
| | | | 750 | 5340 | 61 | 95 | 8.3 | 12.3 |
| | | | 800 | 5500 | 65 | 98 | 3.7 | 5.5 |
| 1400 | 3305 | 2.1 | 600 | 3500 | 6 | 62 | 2.8 | 5.5 |
| | | | 800 | 5550 | 63 | 99 | 3. | 6.1 |
| | | | 950 | 4980 | 51 | 89 | 35 | 68.8 |
| 1800 | 3560 | 1.8 | 650 | 4310 | 21 | 78 | 1.8 | 4.4 |
| | | | 800 | 5540 | 56 | 100 | 2.8 | 6.9 |
| | | | 950 | 5210 | 46 | 94 | 21.6 | 53.2 |
| 2800 | 3770 | 1.7 | 700 | 4710 | 25 | 85 | 1.5 | 5.9 |
| | | | 800 | 5550 | 50 | 100 | 1.6 | 6.3 |
| | | | 950 | 5240 | 42 | 95 | 8.9 | 35.0 |

*$R_{Bulk}$ is sheet resistivity in ohms/square based on a value for nickel bulk resistivity of 7.2 microhm-centimeter For the data shown in Table 4, the temperature coefficients of resistance change from a minimum of 6% to a maximum of 65% increase over their values prior to heat treatment. Table 4 also shows the attained temperature coefficients of resistance as a percentage of the bulk value for nickel source. In this regard, it is seen that for this data, temperature coefficients of resistance are obtained in a range of approximately 60% up to 100% of the bulk value. The sheet resistance in ohms/square for the data shown varies from under 2 ohms/square to over 21 ohms/square. For the various nickel film thicknesses, the ratio of the attained values of sheet resistance to the value for bulk nickel for the same thicknesses are given based on the resistivity of the bulk nickel source of 7.2 microhms-centimeter. This ratio shows that the sheet resistances achieved are approximately 4 to 70 times greater than that provided by the bulk value of the nickel source.

EXAMPLE 4

Respective temperature sensitive devices 10 were prepared in accordance with Examples 1, 2 and 3, except that the resistor elements 10 were subjected to a peak heating temperature of 750° C. and to respective heating cycles of one-half hour, one hour and two hours. The resistor elements 12 were heat treated in a reducing atmosphere of 95 parts nitrogen and 5 parts hydrogen by volume. The temperature sensitive devices 10 were tested for determining their electrical properties, and the results obtained are shown in Table 5.

TABLE 5

| Film Thickness (A) | Time of Heating Cycle @ 750° C. (Hours) | TCR 25 to 100° C. (ppm/°C.) | Sheet Resistance (ohms/square) | Change in TCR By Treatment (ppm/°C.) |
|---|---|---|---|---|
| 1100 | 0.5 | 4470 | 5.99 | 1143 |
| | 1.0 | 5340 | 8.26 | 2013 |
| | 2.0 | 5250 | 39.53 | 1923 |
| 1400 | 0.5 | 4460 | 2.92 | 1155 |
| | 1.0 | 5230 | 1.94 | 1925 |
| | 2.0 | 5330 | 2.43 | 2025 |
| 1800 | 0.5 | 4618 | 1.46 | 1058 |
| | 1.0 | 5220 | 1.78 | 1660 |
| | 2.0 | 5400 | 1.46 | 1840 |

EXAMPLE 5

Temperature sensitive devices were made in a manner similar to those of Example 1 utilizing resistor elements 12 having vacuum deposited thereon a thin film of nickel from a source of high purity bulk nickel. The bulk nickel source provided a temperature coefficient of resistance of about 5620 ppm/°C. The temperature coefficient of resistance of the nickel film of a first group of the resistor elements 12, prior to heat treatment, was 3000 ppm/°C. and its sheet resistance was 6.1 ohms/square, and the temperature coefficient of resistance for a second group of resistor elements was 3380 ppm/°C. and its sheet resistance was 3.4 ohms/square. The reducing heat treatment for the resistor elements 12 was in an atmosphere of 95 parts nitrogen and 5 parts hydrogen by volume or in a reducing atmosphere of 99 parts nitrogen and 1 part hydrogen by volume. Five batches of the first group of resistor elements 12 were respectively heat treated as shown in the first five heat treatments described in Table 6, while the second group of resistor elements 12 were heat treated as described in the last heat treatment of the Table. The temperature sensitive devices 10 were tested for determining their electrical properties, and the results obtained are shown in Table 6.

TABLE 6

| Before Heat Treatment | | | After Heat Treatment | |
|---|---|---|---|---|
| TCR 25-100° C. (ppm/°C.) | Sheet Resistance (ohms/square | Heat Treatment Peak Temp - Cycle Time and Atmosphere | TCR 25-100° C. (ppm/°C.) | Sheet Resistance (ohms/-square) |
| 3000 | 6.1 | 350° C. - 1 hr. in air | 4080 | 6.0 |
| | | 600° C. - 1.5 hr. in $95N_2/5H_2$ | 4380 | 7.3 |
| | | 350° C. - 1 hr. in air, then 600° C. - 1.5 hr. in $95N_2/5H_2$ | 4825 | 42 |
| | | 550° C. - 3 hrs. in $99N_2/1H_2$, then held at 550° C. for .25 hr., and cooled with furnace to 25° C. | 4875 | 5.2 |
| | | 700° C. - 3 hrs. in $99N_2/1H_2$, then held at 700° C. for .25 hr., and cooled with furnace to 25° C. | 5105 24 | |
| 3380 | 3.4 | 350° C. - 1 hr. in air, then 675° C. - 1.5 hr. in $95N_2/5H_2$, then 250° C. - 1 hr. at temperature in air. | 4875 | 2.9 |

In the first heat treatment in Table 6, the resistor elements 12 were subjected to a peak temperature of 350° C. over one hour cycle in air. The temperature coefficient of resistance increased to 4080, while the sheet resistance remained substantially constant. In contrast to the first heat treatment, the second heat treatment at a peak temperature of 600° C. for approximately one and one-half hours in an atmosphere of 95 parts nitrogen to 5 parts hydrogen by volume, resulted in an increased temperature coefficient of resistance and sheet resistance. The third heat treatment, which combined the first and second heat treatments, resulted in a greater increase in the temperature coefficient of resistance and a much higher sheet resistance. In the fourth heat treatment, the resistor elements 10 were subjected to heat treatment at a temperature of 550° for three hours in a very slightly reducing atmosphere, the peak temperature was held for one-quarter hour, and the elements were then cooled with the furnace to 25° C. This treatment also resulted in an increased temperature coefficient of resistance, but with a reduced sheet resistance which was reduced with respect to that of the untreated resistor elements. The fifth heat treatment of Table 6, was similar to the fourth heat treatment, except that the peak temperature was increased to 700° C. and resulted in an increased temperature coefficient of resistance as well as a much higher sheet resistance.

The sixth heat treatment of Table 6, was applied to the resistor elements 10 of the second group having an untreated temperature coefficient of resistance of 3380, and was similar to the third heat treatment, except that the peak temperature of the reducing heat treatment step was increased to 675° C. and a stabilizing heat treatment followed the reducing heat treatment. This resulted in an increased temperature coefficient of resistance and a reduced sheet resistance for the temperature sensitive devices.

From the Examples, there can be seen the effects of variations in the heat treatment and of the nickel film thicknesses on the electrical characteristics of the temperature sensitive device of the present invention. The Examples 1, 2 and 3, show the effects of varying the peak heat treating temperature on devices of different film thicknesses. Example 4 shows the effect of varying the heat treatment cycle time for the same peak heat treating temperature. The effects on the temperature sensitive devices of single and multiple heat treating steps with different heating atmospheres, temperatures and cycle times are shown in Example 5. The FIG. 2 and other data provided also illustrate the effects of the method and the results produced.

In summary, the heat treatment of the invention allows selection of a desired temperature coefficient of resistance for a thin film nickel temperature sensitive device by using a reducing atmosphere and controlling the peak heat treatment temperature and cycle time. Temperature coefficients of resistance can be obtained over a wide range of from 60% to 100% of the value of the bulk nickel source without serious restriction due to the thickness of the nickel film. A maximum temperature coefficient of resistance is achieved at a critical peak heat treating temperature of about 800° C. for the conditions described. The sheet resistance of the devices can be controlled to have values less than, equal to, or greater than the value of the sheet resistance of the unheat treated nickel film resistor element. The desirable properties of high temperature coefficient of resistance may be attained as well as high sheet resistances for film thicknesses under 5000 A. The method of the invention provides control of both the temperature coefficient of resistance and the sheet resistance over a wide range by appropriate selection of the heat treatment conditions and the nickel film thicknesses.

It will be seen that the objects set forth above, among those made apparent from the preceeding description, are efficiently attained and, since certain changes may be made in the above method and device without departing from the scope of the invention, it is intended, that all matter contained in the above description shall be interpreted as illustrative and not in a limiting sense.

What is claimed is:

1. A method of making a thin nickel film temperature sensitive device with a relatively high positive temperature coefficient of resistance utilizing a film of nickel deposited from a bulk nickel source onto an electrically insulating substrate, including the step of heat treating a resistor element having a thin film of nickel deposited on an electrically insulating substrate by heating in a reducing atmosphere to a peak temperature of at least 550° C., over a heating cycle of at least about 20 minutes, whereby the nickel film of the heat treated resistor element has a selected temperature coefficient of resistance which is at least 60% of the value of the coefficient for the bulk nickel and a sheet resistance of at least one ohm per square which properties are determined by the heat treating temperature and cycle time, and the thickness of the nickel film.

2. The method of making a temperature sensitive device in accordance with claim 1 in which the heating atmosphere is slightly reducing.

3. The method of making a temperature sensitive device in accordance with claim 1 in which the heating atmosphere is a mixture of nitrogen and hydrogen.

4. The method of making a temperature sensitive device in accordance with claim 3 in which the volume percent of the hydrogen of the heating atmosphere is less than that of the nitrogen.

5. The method of making a temperature sensitive device in accordance with claim 4 in which the volume percent of the hydrogen of the heating atmosphere is not greater than 15%.

6. The method of making a temperature sensitive device in accordance with claim 5 in which the volume percent of the hydrogen of the heating atmosphere is not greater than 5%.

7. The method of making a temperature sensitive device in accordance with claim 6 in which the volume percent of the hydrogen of the heating atmosphere is not greater than 1%.

8. The method of making a temperature sensitive device in accordance with claim 1 in which the resistor element is heat treated over a heating cycle of between about one-half hour to about four hours.

9. The method of making a temperature sensitive device in accordance with claim 1 in which the resistor element is heat treated to a peak temperature of between about 600° C. and about 950° C.

10. The method of making a temperature sensitive device in accordance with claim 9 in which the resistor element is heat treated to a peak temperature of between about 750° C. and about 850° C., and the heating cycle is between one-half hour and two hours.

11. The method of making a temperature sensitive device in accordance with claim 10 in which the resistor element is heat treated to a peak temperature of about 800° C.

12. The method of making a temperature sensitive device in accordance with claim 3 in which the resistor element is heat treated to a peak temperature of at least about 600° C. for about one and one-half hours in an atmosphere in which the nitrogen is about 95 volume percent.

13. The method of making a temperature sensitive device in accordance with claim 3 in which the resistor element is heat treated by heating in a furnace to a peak temperature of between 550° C. and 700° C. over a period of about 3 hours in an atmosphere in which the nitrogen is about 99 volume percent and the hydrogen is about 1 volume percent, the resistor element is held at the peak temperature for about one-quarter hour, and then allowed to cool with the furnace to a temperature of about 25° C.

14. The method of making a temperature sensitive device in accordance with claim 1, 5, 6, 7, 9, 10 or 12 which includes an auxiliary heat treating step preceding the reducing heat treating step of heating the resistor element in air at a temperature of about 350° C. for a cycle time of about one hour.

15. The method of making a temperature sensitive device in accordance with claim 1, 5, 6, 7, 9 or 10 which includes an auxiliary heat treating step preceding the reducing heat treating step of heating the resistor element in air at a temperature of about 350° C. for a cycle time of about one hour, and a stabilizing heat treating step following the reducing heat treating step of heating the resistor element in air at a temperature of about 250° C. for a period of about one hour.

16. The method of making a temperature sensitive device in accordance with claim 1, 5, 6, 7, 9 or 10 in which the relatively high temperature coefficient of resistance of the device is at least 80% of the value for the bulk nickel.

17. The method of making a temperature sensitive device in accordance with claim 1, 5, 6, 7, 9 or 10 in which the relatively high temperature coefficient of resistance of the device is at least 90% of the value for the bulk nickel.

18. The method of making a temperature sensitive device in accordance with claim 1, 5, 6, 7, 9 or 10 in which the relatively high temperature coefficient of resistance of the device is at least 95% of the value for the bulk nickel.

19. The method of making a temperature sensitive device in accordance with claim 1, 5, 6, 7, 9 or 10 which includes the steps of preparing the resistor element by vacuum depositing the nickel film to the desired thickness onto the insulating substrate, and affixing terminations to the ends of the resistor element and applying a protective outer coating to the nickel film after the heat treating of the element.

20. A thin film temperature sensitive device with a relatively high positive temperature coefficient of resistance utilizing a film of nickel deposited from a bulk nickel source onto an electrically insulating substrate, made by heat treating a resistor element having a film of nickel deposited on an electrically insulating substrate by heating in a reducing atmosphere to a peak temperature of at least 550° C., over a heating cycle of at least about 20 minutes, whereby the nickel film of the heat treated resistor element has a selected temperature coefficient of resistance which is at least 60% of the value of the coefficient for the bulk nickel and a sheet resistance of at least one ohm per square determined by the heat treating temperature and cycle time, and the thickness of the nickel film.

21. The temperature sensitive device made in accordance with claim 20 in which the heating atmosphere is slightly reducing.

22. The temperature sensitive device made in accordance with claim 20 in which the heating atmosphere is a mixture of nitrogen and hydrogen.

23. The temperature sensitive device made in accordance with claim 22 in which the volume percent of the hydrogen of the heating atmosphere is less than that of the nitrogen.

24. The temperature sensitive device made in accordance with claim 23 in which the volume percent of the hydrogen of the heating atmosphere is not greater than 15%.

25. The temperature sensitive device made in accordance with claim 24 in which the volume percent of the hydrogen of the heating atmosphere is not greater than 5%.

26. The temperature sensitive device made in accordance with claim 25 in which the volume percent of the hydrogen of the heating atmosphere is not greater than 1%.

27. The temperature sensitive device made in accordance with claim 20 in which the resistor element is heat treated over a heating cycle of between about one-half hour to about four hours.

28. The temperature sensitive device made in accordance with claim 20 in which the resistor element is heat treated to a peak temperature of between about 600° C. and about 950° C.

29. The temperature sensitive device made in accordance with claim 28 in which the resistor element is heat treated to a peak temperature of between about 750° C. and about 850° C., and the heating cycle is between one-half hour and two hours.

30. The temperature sensitive device made in accordance with claim 29 in which the resistor element is heat treated to a peak temperature of about 800° C.

31. The temperature sensitive device made in accordance with claim 22 in which the resistor element is heat treated to a peak temperature of at least about 600° C. for about one and one-half hours in an atmosphere in which the nitrogen is about 95 volume percent.

32. The temperature sensitive device made in accordance with claim 22 in which the resistor element is heat treated by heating in a furnace to a peak temperature of between 550° C. and 700° C. over a period of about 3 hours in an atmosphere in which the nitrogen is about 99 volume percent and the hydrogen is about 1 volume percent, the resistor element is held at the peak temperature for about one-quarter hour, and then allowed to cool with the furnace to a temperature of about 25° C.

33. The temperature sensitive device made in accordance with claim 20, 24, 25, 26, 28, 30 or 31 which includes an auxiliary heat treating step preceding the reducing heat treating step of heating the resistor element in air at a temperature of about 350° C. for a cycle time of about one hour.

34. The temperature sensitive device made in accordance with claim 20, 24, 25, 26, 28 or 29 which includes an auxiliary heat treating step preceding the reducing heat treating step of heating the resistor element in air at a temperature of about 350° C. for a cycle time of about one hour, and a stabilizing heat treating step following the reducing heat treating step of heating the resistor element in air at a temperature of about 250° C. for a period of about one hour.

35. The temperature sensitive device made in accordance with claim 20, 24, 25, 26, 28 or 29 in which the relatively high temperature coefficient of resistance of the device is at least 80% of the value for the bulk nickel.

36. The temperature sensitive device made in accordance with claim 20, 24, 25, 26, 28 or 29 in which the relatively high temperature coefficient of resistance of the device is at least 90% of the value for the bulk nickel.

37. The temperature sensitive device made in accordance with claim 20, 24, 25, 26, 28 or 29 in which the relatively high temperature coefficient of resistance of the device is at least 95% of the value for the bulk nickel.

38. The temperature sensitive device made in accordance with claim 20, 24, 25, 26, 28 or 29 which includes the steps of preparing the resistor element by vacuum depositing the metal film into the insulating substrate to the desired thickness, and affixing terminations to the ends of the resistor element and applying a protective outer coating to the nickel film after the heat treating of the element.

* * * * *

UNITED STATES PATENT AND TRADEMARK OFFICE

CERTIFICATE OF CORRECTION

PATENT NO. : 4,323,875

DATED : April 6, 1982

INVENTOR(S) : Joseph A. Tentarelli, Richard L. Wahlers and John G. Woods

It is certified that error appears in the above-identified patent and that said Letters Patent are hereby corrected as shown below:

Column 2, line 45; "350°" should read - 350°C -

Column 2, line 48; "250°" should read - 250°C -

Column 3, line 22; "12" should read - 13 -

Column 4, line 41; °a should read - a -

Column 5, line 64; "B" should be omitted

Column 8, line 5; "10" should read - 12 -

Column 9, Table 6, line 24; "24" should be moved to the right and be listed under the column entitled Sheet Resistance (ohms/square)

Column 9, line 52; "10" should read - 12 -

Column 9, line 66; "10" should read - 12 -

Signed and Sealed this

*Thirteenth* Day of *July 1982*

[SEAL]

*Attest:*

GERALD J. MOSSINGHOFF

*Attesting Officer*

*Commissioner of Patents and Trademarks*